United States Patent [19]

Cawley

[11] 4,261,759

[45] Apr. 14, 1981

[54] METHOD OF TREATING WATER DAMAGED FLOOR COVERINGS

[75] Inventor: Martin Cawley, Ft. Lauderdale, Fla.

[73] Assignee: Ace Rug Cleaners, Inc., Ft. Lauderdale, Fla.

[21] Appl. No.: 95,426

[22] Filed: Nov. 19, 1979

[51] Int. Cl.[3] ..... B08B 5/00; F26B 5/00; D06B 1/00; D06B 21/00

[52] U.S. Cl. ..... 134/6; 8/137; 8/150; 34/23; 34/70; 134/30; 134/36; 134/37

[58] Field of Search ..... 134/6, 30, 36, 37, 42; 34/23, 70; 8/137, 150; 68/19.1

[56] References Cited

U.S. PATENT DOCUMENTS

| | | | |
|---|---|---|---|
| 1,198,373 | 9/1916 | Olson | 8/150 X |
| 1,741,755 | 12/1929 | Chase et al. | 34/70 |
| 2,189,209 | 2/1940 | Jamgotch | 8/137 |
| 2,236,430 | 3/1941 | Hurxthal | 34/70 |
| 3,739,483 | 6/1973 | Windhorst | 34/23 |
| 4,035,148 | 7/1977 | Metzger et al. | 8/137 |

*Primary Examiner*—Marc L. Caroff
*Attorney, Agent, or Firm*—Arthur W. Fisher, III

[57] ABSTRACT

A water damaged carpet and pad assembly are restored to their normal condition while substantially maintained in an installed, normal floor covering position by extracting excess water from the upper surface of the carpet, applying mildecides, cleaning and drying agents to the upper surface of the carpet, blowing air under the carpet and pad assembly for drying purposes and then deodorizing the carpet and pad assembly by introducing a deodorizing agent into a current of forced air directed to flow between the under surface of the carpet and the upper surface of the pad.

11 Claims, 4 Drawing Figures

METHOD OF TREATING WATER DAMAGED FLOOR COVERINGS

BACKGROUND OF THE INVENTION

1. Field of the Invention

This invention relates to a method for restoring a water damaged floor covering particularly a carpet and pad assembly while the floor covering assembly is maintained in its normal installed, floor covering position, thereby eliminating the need to remove the water damaged carpet and pad assembly for treatment.

2. Description of the Prior Art

Methods directed to the cleaning and like treatment of carpets, rugs and like floor coverings have been known for many years. Since at least as early as the 1950's such cleaning methods and processes have incorporated the use of mechanized equipment specifically designed to apply a washing composition to the carpet surface and then remove the soil and cleaning composition residue from the surface.

More recently mechanized apparatus has been designed which is structured to utilize steam treatment of the exposed surface of a carpet. This surface is rinsed and the rinsing composition residue as well as the soil is removed through a vacuum apparatus.

The above noted prior art methods are all primarily directed to the cleaning of the exposed surface area of a carpet type floor covering. As set forth above these methods are primarily designed to remove soil and dirt from the exposed surface in the various manners indicated.

However, certain situations arise wherein large portions of carpet areas suffer more extensive damage due to their exposure to excess water. Frequently, when household or commercial plumbing overflows, large areas of floor covering particularly carpeting becomes totally or at least partially submerged. This exposure to excess water causes serious water damage due at least in part to the prolonged exposure of not only the outer carpet surface but the under pad assembly as well.

Conventional or prior art methods used to restore such water damaged carpet to its original condition generally involves the entire removal of the damaged carpet and pad assembly and the conducting of the cleaning and restorative processes at the plant or shop. This was generally considered necessary to due to the extensive drying that took place when both the carpet and supporting pad assembly were totally soaked with the over exposure to water. It is obvious that the latter process involving the total removal of the damaged carpet and pad assembly was much more time consuming and accordingly expensive.

In order to overcome the inherent problems of the aforementioned prior art procedures, there is an obvious need in the floor covering industry for a cleaning, drying and/or restorative method which can be performed directly on the water damaged carpet and pad assembly while maintained in place in the residence or commercial dwelling in which the carpet assembly was originally installed. This obviously would eliminate both time and expense of restoring such damaged floor covering. In addition the method and/or procedure involved should be sufficiently effective to totally bring back or restore the effected carpet assembly to the point of utilization prior to the excess exposure to water or like harsh environment.

Finally, such a desired method should be sufficiently effective to perform adequate restorative treatment to carpet assemblies and like floor coverings which have been totally submerged in either fresh or salt water as when flooding occurs.

SUMMARY OF THE INVENTION

The present invention is directed toward a method of treating water damaged floor coverings especially carpet and cushioning pad assemblies for the purpose of restoring such damaged floor covering to their original condition. Further, an important feature of the subject method is the ability to perform restorative steps on the carpet and pad assembly while it is maintained in its originally installed position in floor covering relation to the floor surface. This in turn eliminates the problems and excessive costs in cleaning and/or treating water damaged carpet and pad assemblies by conventional methods which frequently involve the removal of the floor covering and the transporting of such assembly to the plant or shop for extensive treatment.

More specifically the method of the present invention is instigated by first removing all excess water from the carpet and pad assembly. This may be accomplished by vacuuming any standing water and then by applying pressure by a weighted roller or like device to the carpet and pad assembly. The latter step involves forcing any water within the carpet and pad assembly interior in a specifically directed manner so that this excess water can also be vacuumed and thereby removed.

The carpet is then cleaned by selectively applying a cleaning composition, a drying composition and a mildecide composition. Such application can be accomplished through the use of conventional and/or prior art mechanisms wherein each of the three compositions are stored separately and selectively forced on the exterior surface of the carpet through proper valving and utilizing conventional delivery or application equipment. More specifically the cleaning composition may comprise conventional water base cleansing agents. Also, the subject mildecide is applied to prevent mildew or deteoriation of the carpet and pad assembly because of excess exposure to water. Finally a drying composition including a drying agent characterized by a high rate of evaporation, when exposed to greater than ambient temperature, is added to the exposed surface of the carpet. Such application of the drying composition may be done selectively after the application of the cleaning composition and the mildecide or concurrently with the cleaning composition. In that the cleaning composition itself is heated, generally to a temperature of approximately 180° degrees F. the application of the drying agent aides in the overall drying of the carpet and pad assembly due to the high rate of evaporation of the drying agent, especially in the presence of excess heat. While numerous drying agents can be utilized such products generically known as amylacetate or any alcohol base composition, proven non harmful to the material of the rug and pad assembly can also be utilized. Generally such compositions are removed immediately after the application through utilization of known delivery and removal equipment of the type produced and commercially developed by the Hydra-Master Corporation of Lynwood, Washington.

The carpet and pad assembly is then dried through exposure of specifically the under portions and, in a preferred embodiment of the present method combined under portions and exposed surface of the carpet and pad assembly. The subject assembly is blow dried by forcing air flow along a predetermined path of travel throughout the under portions of the carpet and pad assembly, while the assembly is maintained in its original installed position. The establishment of an air path causes extensive billowing of the carpet and pad assembly and a substantial distribution of the drying air flow throughout major portions of the under portions of the carpet and pad assembly.

Finally, a deodorizing process is utilized wherein the aforementioned path of air flow is effectively closed, at least in part, and a deodorizing agent in a fog or mist state is introduced into the current of forced air which is specifically directed between the under surface of the carpet and the upper surface of the supporting or cushioning pad assembly. The closing of the stablished path of air flow forces the deodorizing agent, entrained within the air current to be forced up through the fibers of the carpet and exit the under portions of the assembly directly through the carpet itself. Such deodorizing process is particularly important due to the fact that most backing of carpet and rug products are formed from a jute material. When exposed to excess amounts of water as when flooding develops or the like, this jute backing gives off an extremely undesirable odor which has a tendency to last even when normal cleaning methods are performed on the exterior surface of the carpet.

Finally, in order to insure the utmost in restorative treatment to the subject carpet and pad assembly, a supplementary cleaning process may be performed on the exposed surface of the carpet wherein such supplementary process involves steam cleaning.

It should be noted that an important feature of the subject method involves the performing of the above noted steps efficiently and effectively on a carpet and pad assembly while such an assembly is maintained in its originally installed, in place position on the floor or other surface which it is covering. This in turn does away with the expense, time and associated problems involved in total removal of the carpet and pad assembly for restorative treatment off premises.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

The present invention is directed toward a method of restoring water damaged floor coverings, especially a carpet and pad assembly type floor covering wherein such restorative steps of the subject method can be performed on the carpet and pad assembly while it is installed in its normal and original floor covering position.

The method includes first removing all excess water either standing on the exposed surface of the carpet as when flooding occurs or the excess water which permeates the interior portion of the carpet and pad assembly. In the case of excess, standing water, removal thereof can take place through substantially known or conventional vacuum equipment.

Figure 1:
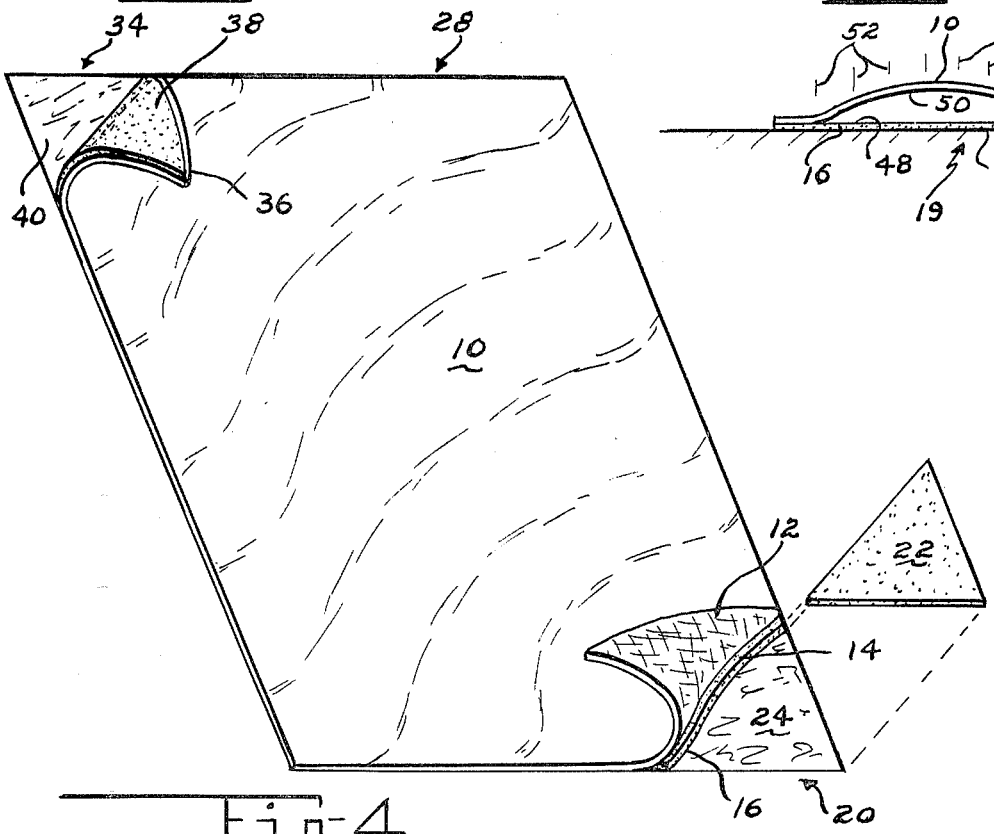
FIG. 1 is a perspective view of the carpet and pad assembly being treated.
Figure 3:
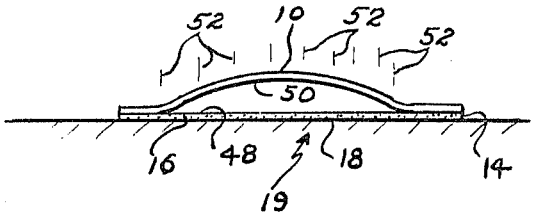
FIG. 3 is an end view in partial cutaway showing the interior and under portions of the rug and pad assembly.

In addition, when such standing excess water is removed overall treatment and drying of the carpet and pad assembly is greatly facilitated when the excess water existing throughout the interior and under portions of the rug and pad assembly are removed. This, is preferably performed by applying a force and/or pressure on the exposed surface of the carpet so as to effectively "squeeze" out all water. More specifically prior to such application of force an access is formed in the carpet and pad assembly. Such access is produced by folding over one end or preferably one corner portion of the rug. In addition, the then exposed pad assembly is severed and removed for the purpose of exposing the bare floor as well as certain interior portions of the pad assembly itself. With reference to FIGS. 1 and 3 the carpet 10 has one corner thereof 12 essentially folded over about itself as clearly shown in FIG. 1. This then exposes the under pad assembly 14 which is provided to normally serve as a cushion or as a support for the carpet 10. The exposed pad assembly is then severed along a sever line 16 so as to expose the interior portion 18 (FIG. 3) as well as the under portion of both the carpet 10 and pad 14. This under portion collectively is represented as 18 as shown in FIG. 3. Similarly the access which may be termed a first access portion is generally indicated at 20. After forming the sever line 16 the cutaway pad assembly portion 22 may be totally removed therefrom so as to expose the previously covered floor surface 24.

Figure 4:
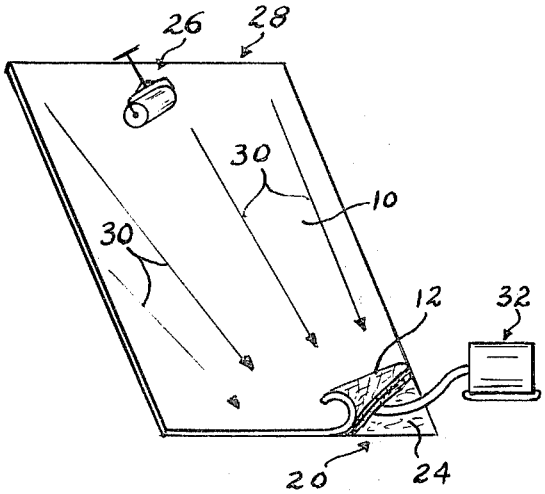
FIG. 4 is a perspective view in partial schematic showing another step of the subject method.

With specific reference to FIG. 4 the exposed first access portion 20 thereby allows clear access to the exposed surface 24 of the floor. Pressure and/or force in the form of a weighted roller assembly generally indicated as 26 is applied to the exposed surface of carpet 10 by rolling or moving the weighted roller systematically from the distal end 28 of the carpet and pad assembly towards the first access portion 20 as generally indicated by the directional arrows 30. Application in a systematic and continuous fashion of force to the exposed surface of the carpet 10 serves to "squeeze" out any excess water which serves to soak the carpet and pad assembly. Furthermore, such water is driven or directed to the first access portion 20 so as to collect on the exposed surface 24 of the floor also as shown in FIG. 4. A vacuum assembly generally indicated as 30 may be positioned so as to remove such access water as it is driven out of the carpet and pad assembly through the application of the pressure or force as exerted on the carpet and pad assembly by weighted roller assembly 26.

A cleaning process is then exposed to the exterior or exposed surface of the rug by the selective, independent or combined application of a cleaning composition, mildecide composition and drying composition. Such application may be provided through the use of conventional or known apparatus wherein proper valving is provided to cause the selective, independent application or the combined application on the exposed surface of the carpet. Proper valving can be adapted to conventional applicator equipment to accomplish the selective or combined application by merely operating such valving to either blend the three aforementioned compositions or applying them independently. Irrespective of the method of application of the individual compositions, it should be noted that the cleaning composition may be any water base detergent capable of effectively removing dirt, soil and similar residue from the exposed surface of the carpet 10. Similarly, the mildiscide composition may be any conventional mildecide capable of application to carpet material for the purpose of protecting against formation of mildew and like deteoriation. Finally, the drying composition incorporates the use of drying agent such as amylacetate or other alcohol base compositions which are particularly characterized by a high rate of evaporation, particularly when exposed to a heat at a temperature greater than ambient. Due to the fact that the cleaning composition or the overall combination of compositions are applied to the exposed surface of carpet 10 after being heated approximately to 180° degrees F., the existence of the drying composition serves to aid in the overall drying of the rug and pad assembly. This occurs due to the direct exposure and contact of the drying agent to the material forming the carpet and pad assembly. Removal of the various compositions may take place substantially immediately as when using conventional application and vacuum equipment or after a predetermined period of time.

After such cleaning process has occurred and upon removal of the various aforementioned compositions a primary drying process is performed to accomplish total removal of all liquid from the carpet and pad assembly. This drying process at least in the initial phase includes the formation of a path of air flow through the under portions of the carpet and pad assembly. More specifically such path of air flow is formed by providing the first access portion 20 in the manner set forth above. In addition, a second access portion 34 is formed in opposed relation to the first access portion 20 generally at the distal end thereof 28. Preferably the first and second access portions 20 and 34 respectively are disposed at diagonally opposed corners from one another (FIG. 1) as shown.

Figure 2:
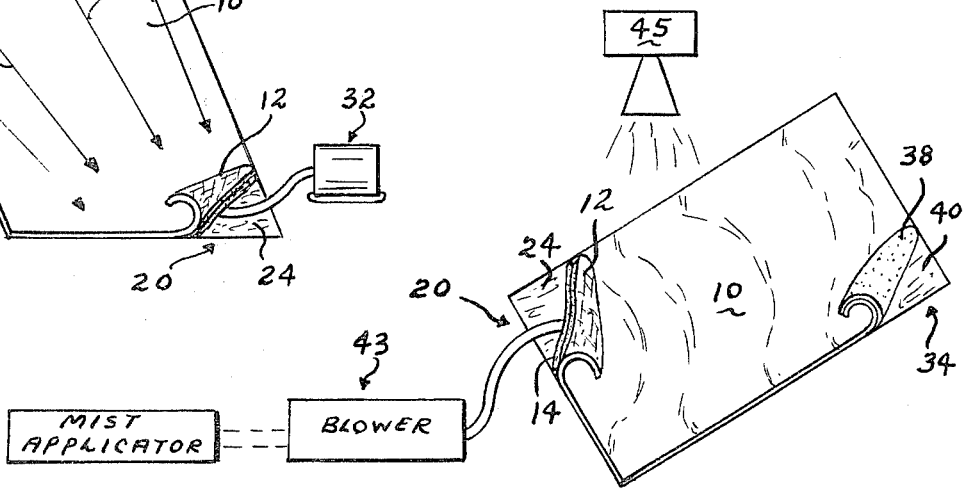
FIG. 2 is a schematic view representative of various steps of the subject method.

The second access portion 34 is formed by positioning a corner or like portion 36 of carpet 10 in a folded over relation upon itself. Also the correspondingly positioned pad assembly 38 is also disposed in folded over relation again so as to expose the under portions as at 40 and 19 (FIGS. 1 and 3) of the second and first access portion 34 and 20 respectively. Therefore, the path of air flow is defined effectively between the first and second access portions 20 and 34 through the under portions of the carpet and pad assembly 10 and 14. Drying thereby occurs through the effective blow drying of the entire carpet and pad assembly by directing a forced flow of air along the path of air flow. With reference to FIG. 2 a blower assembly, which may be of conventional design, and generally indicated as 43 is disposed to direct the forced flow of air into the first access portion 20 through the under portions of the carpet and pad assembly. Such forced flow of air travels along the path of air flow through the under portions of the carpet and pad assembly and travels to the point of least resistance which is effectively defined by the second acess portion 34. The presence of the forced air flow causes a billowing or rising of the carpet and pad assembly since the forced air flow from blower 43 causes the forced air to pass over the surface of the floor 24 through the pad assembly 14 and along the under surface of the carpet 10. Based on the specific structure of carpet 10 certain amounts of air will escape directly through the fibers of the backing and exposed surface of carpet 10 which of course will aid in the effective drying through the continuous passage of such forced air flow.

Again with reference to FIG. 2 an additional embodiment of the present invention is the directing of an auxiliary or supplementary air flow from a blower mechanism 45, of conventional design, over the exposed surface of carpet 10 as schematically represented in FIG. 2. This supplementary air flow is directed concurrently to the forced air flow through the under portions of the carpet and pad assembly and along the path of air flow as defined above. Dependent upon the extent of the exposure to excessive water, the predetermined period of time for application of the air flow is generally two to three days so as to insure complete drying of the carpet and pad assembly. It should be noted however, that the predetermined time for exposure of such air flow is of course dependent upon the individual situations.

The present method further includes the provision of a deodorizing process. Such deodorizing process is of particular importance to total restoration of most carpet and pad assemblies. This is particularly true since existing carpets frequently incorporate jute backing. Such material gives off an extremely offensive odor when exposed to excessive amounts of water for any prolonged period. Conventional deodorizing methods of applying a deodorant composition to the exterior surface only of a carpet structure frequently does not effectively eliminate the offensive odor since such deodorizing agent does not reach or obtain full exposure to the jute backing of popular carpet construction.

Accordingly the deodorizing process of the present method invention comprises the complete and thorough introduction of a deodorizing agent, in a mist or fog form directly into an air current of the type produced by blower 43, (FIG. 2.). Such deodorizing agent in the mist form may be supplied by a thermogenerating gun of conventional design exposed to the blower intake such that the produced forced flow or current of air is directed to the under portions of the rug and carpet assembly. More specifically the current of air with the entrained deodorizing agent mist therein is directed between the carpet 10 and the pad assembly 14. Such current of air travels between the upper or exposed surface of the pad assembly as at 48 (FIG. 3) and between the under surface 50 of the carpet 10. An important feature of this particular step of the subject method includes the closing off of the previously established path of air flow. This closing off occurs by the positioning and rearranging of the pad and carpet portions 38 and 36 so as to close or seal off the second access portion 34. Accordingly, while the current of air with entrained deodorizing agent mist therein is forced into the first access portion 20 between the carpet and pad assembly, there exists no easy or effective access as at access portion 34 since such latter access portion has been closed. Therefore the deodorizing agent as carried by the current of air has the specific tendancy to exit directly through the ibers of the backing and the remaining structure of the carpet 10. As generally indicated in FIG. 3 the passage of the deodorizing agent entrained in the forced current of air passes upwardly through the carpet 10 as indicated by mist tracings 52 (FIG. 3). The forced current of air with the deodorizing mist therein passes through the carpet 10 for a minimal period of apporximately 10 seconds. The exact time of application is of course dependent upon the estimated amount of damage done.

Upon completion of the above set forth steps the carpet and pad assembly is then totally repositioned, including the closing of the access portion 20 such that the carpet and pad assembly is in its normally installed floor covering position.

Complete treatment of the carpet and pad assembly to insure total restorative condition may further incorporate the process of steam cleaning the exposed surface of the carpet 10 in what may be a considered a conventional fashion.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A method of restorative treatment of water damaged carpet and pad assembly while substantially maintained in an installed, normal floor covering position, said method comprising the steps of:

(a) extracting excess water from the upper exposed surface of the carpet, (b) positioning the carpet and pad assembly to provide access to under portions thereof and portions of the floor being covered, (c) said positioning of the carpet and pad assembly comprises removing one portion of the carpet from its floor covering position and folding it over substantially upon itself, severing one portion of the pad assembly in the area of the removed carpet and removing the severed pad portion thereby exposing a floor portion previously covered, said severing of the pad assembly accomplished to provide exposure to the interior of the pad assembly, (d) applying force in systematic directional motion to the upper surface of the carpet, whereby excess water is directed toward the access to the under portions of the carpet and pad assembly, (e) removing excess water from said access, (f) establishing a path of air flow through said access to under portions of the carpet and pad assembly, (g) directing forced air flow at least along the established path of air flow, for a predetermined period of time for the purpose of drying the carpet and pad assembly and (h) positioning the carpet and pad assembly to close the access to under portions thereof upon the end of the predetermined period of time, whereby the carpet and pad assembly is restored to the intended condition while in place.

2. A method of restorative treatment of water damaged carpet and pad assembly, while substantially maintained in an installed normal floor covering position, said method comprising the steps of:

(a) extracting excess water from the upper exposed surface of the carpet, (b) positioning the carpet and pad assembly to provide access to under portions thereof and portions of the floor being covered, (c) applying force in systematic directional motion to the upper surface of the carpet, whereby excess water is directed toward the access to the under portions of the carpet and pad assembly, (d) removing excess water from said access, (e) establishing a path of air flow through said access to under portions of the carpet and pad assembly, (f) establishing said path of air flow by positioning a first portion of the carpet and pad assembly to provide access to the under portion thereof, positioning a second portion of the carpet and pad assembly to provide additional access to the under portion thereof, disposing said first and second portions in spaced apart relation to one another at substantially opposing ends of the carpet and pad assembly, whereby said path of air flow extends beneath the carpet along a major under portion thereof and between said first and second portions, (g) directing forced air flow at least along the established path of air flow, for a predetermined period of time for the purpose of drying the carpet and pad assembly, (h) deodorizing the carpet by directing a current of forced air through an access and between the under surface of the carpet and the upper surface of the pad assembly and introducing a deodorizing agent in mist form into said current of forced air, whereby a major portion of the carpet under surface is exposed to the deodorizing agent, (i) positioning the carpet and pad assembly to close the access to under portions thereof upon the end of the predetermined period of time, whereby the carpet and pad assembly is restored to the intended condition while in place.

3. A method as in claim 2 wherein said first portion and said second portion of said carpet and pad assembly each comprise a corner portion disposed in spaced apart diagonally opposing disposition to one another.

4. A method as in claim 2 wherein the process of directing air flow along the established path of air flow comprises forcing air between the surface of the floor being covered and the under surface of the pad assembly between the first and second portions which provides access to the under portions of said carpet and pad assembly.

5. A method as in claim 4 further comprising the steps of directing a supplementary forced air flow over the exposed surface of the carpet concurrently to directing forced air along the established path of air flow.

6. A method as in claim 1 wherein applying force to the carpet comprises directing a weighted roller assembly continuously over the exposed carpet surface from the distal end of the carpet relative to said access toward said removed pad portion, whereby excess water is forced from said carpet and pad assembly due to said applied force.

7. A method as in claim 1 further comprising the steps of cleaning the carpet and pad assembly prior to directing forced air flow along said established path of air flow, said cleaning including applying a cleaning composition to the exposed surface of the carpet, applying a drying composition in liquid form to the exposed surface of the carpet and removing the cleaning and drying compositions after a predetermined period of application.

8. A method as in claim 7 wherein said cleaning composition and said drying composition are selectively applied concurrently to the exposed surface of the carpet and removed substantially immediately after application.

9. A method as in claim 7 wherein cleaning the carpet and pad assembly further includes applying a mildecide composition to the exposed surface of the carpet and applying each of the cleaning, drying, and mildecide compositions in a selective sequence, and further removing each of said compositions substantially immediately after application.

10. A method as in claim 8 wherein said cleaning composition is preheated to substantially a predetermined temperature before application to the exposed surface of the carpet and said drying composition is characterized by a high rate of vaporation when exposed to above ambient temperature, whereby drying of the carpet and pad assembly is facilitated.

11. A method as in claim 2 further comprising the steps of closing either said first and second access portion and leaving only one access to the under portion of said carpet and pad assembly, directing the current of forced air and introduced deodorizing agent through said one access under pressure and causing the current of forced air to rise through the carpet from the under surface thereof to the exposed surface thereof due at least in part to the closing of the established path of air flow.

* * * * *